United States Patent [19]

Baines

[11] 4,336,741

[45] Jun. 29, 1982

[54] LIQUID PROPELLANT VELOCITY ASSISTANCE SYSTEM FOR GUNS

[75] Inventor: William R. Baines, Lake Elsinore, Calif.

[73] Assignee: Ford Motor Company, Dearborn, Mich.

[21] Appl. No.: 112,779

[22] Filed: Jan. 17, 1980

[51] Int. Cl.[3] ..... F41F 1/04

[52] U.S. Cl. ..... 89/7; 89/8

[58] Field of Search ..... 89/7, 8

[56] References Cited

U.S. PATENT DOCUMENTS

| | | | |
|---|---|---|---|
| 484,011 | 10/1892 | Haskell | 89/8 |
| 2,129,875 | 9/1938 | Rost | 89/7 |
| 2,397,800 | 4/1946 | McArthur | 89/8 |
| 2,648,257 | 8/1953 | Stanley | 89/8 |
| 2,995,987 | 8/1961 | Fitzpatrick | 89/7 |
| 3,011,404 | 12/1961 | Russell | 102/38 |
| 3,138,990 | 6/1964 | Jukes et al. | 89/7 |
| 3,457,826 | 7/1969 | Stott | 89/8 X |
| 3,459,101 | 8/1969 | Scanlon et al. | 89/8 |
| 3,496,827 | 2/1970 | Dardick | 89/8 |
| 3,503,300 | 3/1970 | Dardick | 89/8 |
| 3,803,975 | 4/1974 | Elmore | 89/7 |
| 3,880,044 | 4/1975 | Korr et al. | 89/8 |
| 3,915,057 | 10/1975 | Broxholm et al. | 89/7 |
| 3,916,792 | 11/1975 | Elmore et al. | 102/38 |
| 3,969,978 | 7/1976 | Seifert et al. | 89/7 |
| 4,023,463 | 5/1977 | Tassie | 89/7 |
| 4,063,486 | 12/1977 | Ashley | 89/7 |
| 4,100,836 | 7/1978 | Hofmann | 89/7 |
| 4,172,408 | 10/1979 | Ayler et al. | 89/7 |

*Primary Examiner*—David H. Brown

*Attorney, Agent, or Firm*—Steven L. Permut; Clifford L. Sadler

[57] ABSTRACT

A liquid propellant velocity assistance mechanism for a gun in one embodiment includes separate gas operated injectors for metering liquid fuel and liquid oxidizer into the bore of the gun after it has been fired and before the projectile has left the barrel. Each injector has an inlet connecting the bore of the gun to a gas receiving cavity section. An outlet extends from the liquid receiving cavity section to the bore. A piston separates the two cavity sections and is slidably moveable to increase and decrease the volume of each section. A valve normally closes the outlet between the liquid receiving cavity and the bore and is openable in response to liquid pressure. The high pressure gas behind the projectile when the gun is fired flows into the gas receiving section and pushes against the piston to create such higher liquid pressure. The respective injectors inject liquid oxidizer and fuel into the bore of the gun behind the projectile such that the oxidizer and fuel are mixed within the bore and ignited by the presence of hot gasses from the initial explosion. The gas pressure behind the projectile is thereby increased such that the muzzle velocity of the projectile is increased.

24 Claims, 4 Drawing Figures

LIQUID PROPELLANT VELOCITY ASSISTANCE SYSTEM FOR GUNS

BACKGROUND OF THE INVENTION

1. Field of the Invention

This invention relates to a velocity assistance system for projectiles fired from a gun and more particularly to a liquid propellant injection system therefor.

2. Description of the Prior Art

Multicharge guns have been known to use sequential explosions to increase the velocity of a projectile after the initial explosion and during the period the projectile is traveling down the barrel of the gun. Examples of such multicharge guns are disclosed in U.S. Pat. No. 484,011 issued to Haskell on Oct. 11, 1892 and U.S. Pat. No. 3,459,101 issued to Scanlon, Jr., et al on Aug. 5, 1969.

In addition it is also known to use a powder propellant packed within a side chamber which is ignited by gases emanating from the original projectile explosion. The subsequent explosion causes more highly pressurized gas to open a valve within the gun and to pass from the side chamber into the barrel to further propel the projectile. On such example is shown in U.S. Pat. No. 2,397,800 issued to McArthur on Apr. 2, 1946.

A side chamber which is automatically refilled with powder is disclosed in U.S. Pat. No. 2,648,257 issued to Stanley on Aug. 11, 1953.

It is also known to use liquid propellants to initiate the propulsion of projectiles down a barrel. U.S. Pat. No. 3,803,975 issued to Elmore, et al on Apr. 16, 1974 discloses a gun mechanism which has a combustion chamber automatically filled with liquid propellant. The liquid propellant explodes to propel the projectile out of the gun.

U.S. Pat. No. 3,915,057 issued to Broxholm et al on Oct. 28, 1975 discloses a liquid propellant gun which has a supply chamber which is filled with liquid. The filling mechanism is powered by gases from a previous explosion. The liquid is then ejected into the firing chamber and is ignited to propel the subsequent round.

SUMMARY OF THE DISCLOSURE

According to the invention, a velocity assistance mechanism for a projectile firing gun comprises injector systems that inject fuel and oxidizer components of a propellant into a bore of the gun behind the projectile after the projectile is fired. The fuel and oxidizer are ignited by the hot gases of the initial firing charge whereby gas pressures are increased and the projectile is accelerated. Each injector system includes a cavity filled with liquid propellant. The cavity has an inlet and an outlet in fluid communication with the bore of the barrel of the gun. Gas emanating from the initial propelling explosion when the gun is fired enters the inlet to drive the liquid propellant out of the cavity through the outlet and into the bore of the barrel. The propellant ignites to increase the gas pressure behind the projectile and thereby increases the velocity of the projectile before it exits the barrel.

In one embodiment, a valve normally biased to the closed position closes the outlet of the cavity and is openable in response to pressure within the cavity. Such pressure is exerted on the propellant in the cavity by the gas pressure which forces open the valve of the initial explosive charge.

The cavity has a liquid receiving section and a gas receiving section with a piston situated therebetween and moveable to increase and decrease the volume of each section. In addition the piston acts as a heat insulator to prevent the propellant from being ignited by contact with the hot gases from the initial explosion. The inlet communicates with the gas receiving section and the outlet communicates with the liquid propellant receiving section. The piston is movable into the liquid receiving section under influence of the high pressure gas entering the inlet and into the gas receiving section. The piston is stepped such that the surface thereof facing the gas receiving section is larger than the surface thereof facing the liquid receiving section.

As the projectile passes the inlet, high pressure gas propelling the projectile rushes into the gas receiving cavity which drives the piston to push the liquid propellant through the outlet valve and into the barrel where it ignites to give the projectile an additional increase in velocity.

Preferably, liquid fuel and liquid oxidizer velocity assistance system has two injector systems with two separate cavities, one which receives a liquid fuel component and the other which receives a liquid oxidizer component of the liquid propellant. The gas from the initial explosion enters the inlets to each cavity to drive out the fuel component and oxidizer component into the bore of the barrel where the oxidizer and fuel mix and ignite to increase the velocity of the projectile at the muzzle of the gun.

A gun equipped with a velocity assistance mechanism according to the present invention has the advantages of increasing the exit velocity of a projectile without the necessity of increasing the structural strength of the firing chamber and barrel. In addition, in the illustrated embodiments the increase in velocity is accomplished by injecting fuels and oxidizers through separate injector systems where the fuel and oxidizers are mixed together at the last moment to reduce risk of premature ignition.

BRIEF DESCRIPTION OF THE DRAWINGS

Reference now will be made to the following drawings in which.

DETAILED DESCRIPTION OF THE PREFERRED EMBODIMENTS

Figure 1:
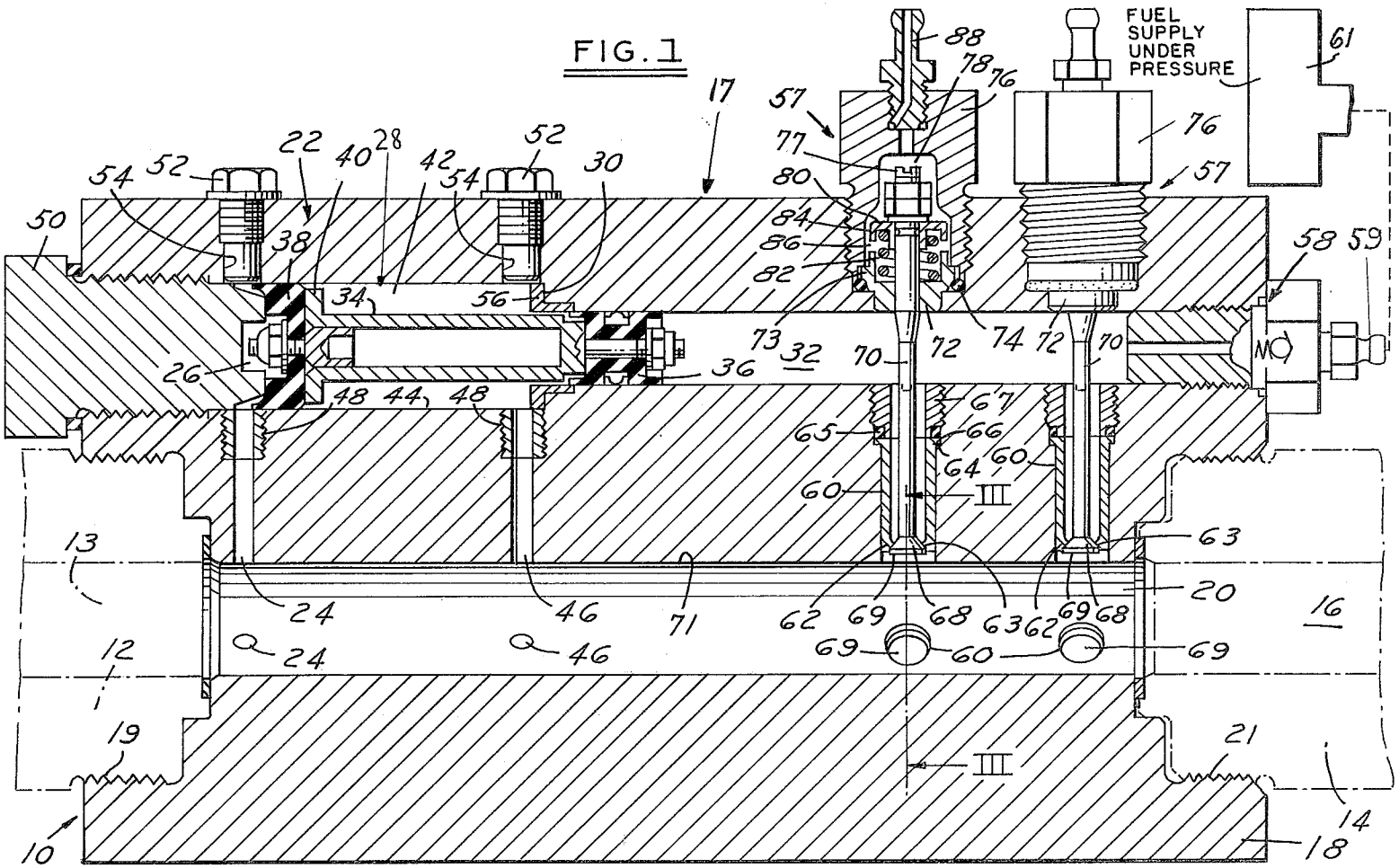
FIG. 1 is a sectional view of a portion of a gun incorporating an embodiment of a liquid propellant velocity assistance mechanism according to the invention.
Figure 3:
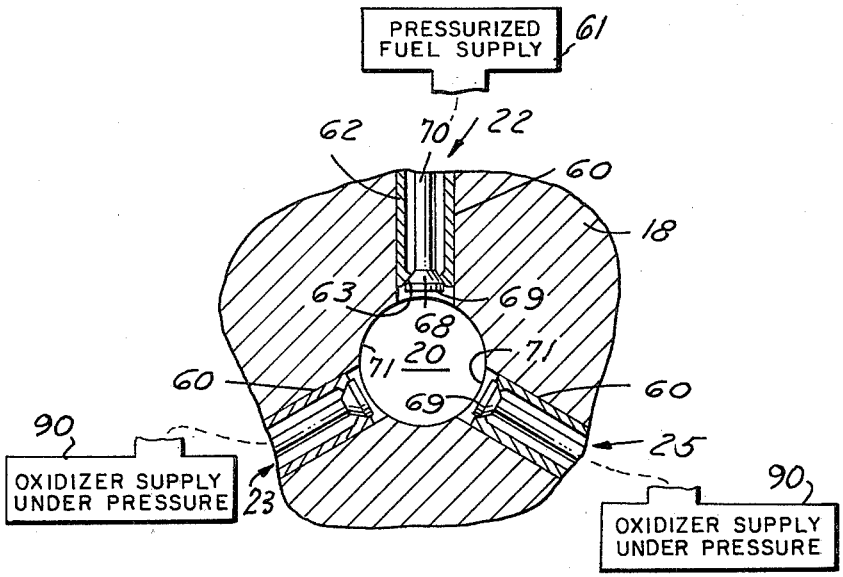
FIG. 3 is a cross-sectional view taken along the lines III—III in FIG. 1.

Referring now particularly to FIG. 1, a gun 10 has a firing chamber section 12 with a bore 13 therein leading from the firing chamber (not shown). A barrel section 14 has a bore 16 passing therethrough. The gun also includes a velocity assistance mechanism 17 which is situated between gun section 12 and barrel section 14. The velocity assistance mechanism 17 includes an injector housing 18 which is threadably secured at ends 19 and 21 to the gun section 12 housing the firing chamber 12 and the barrel 14 respectively. The housing 18 has a bore 20 aligned with bore 16 and bore 13 which in turn is aligned with the longitudinal axis of the firing chamber. The housing 18 houses three injector systems generally indicated as 22, 23 and 25 as shown in FIG. 3. Circumferentially spaced about bore 20 at the same axial point therealong injector system 22 injects a liquid fuel component of a propellant into bore 20 and injector systems 23 and 25 are used to inject a liquid oxidizer component of the propellant into the bore 20. The injector systems are identical in structure so reference will be made only to the injector system 22 for a detailed description.

The injector system 22, has an inlet 24 communicating bore 20 to a variable volume gas receiving section 26 of a cylindrical cavity 28 laying parallel to bore 20. The inlet 24 is axially spaced from the firing chamber section 12. The cylindrical cavity 28 has a shoulder 30 and extending therefrom a narrower liquid receiving section 32.

A stepped piston 34 has a piston head 36 slidably fitted in liquid receiving section 32 and a larger piston head section 38 slidably fitted within gas receiving section 26. The piston has a shoulder section 40 which forms a transition from the narrow head section 36 to the larger diameter head section 38. An annular chamber 42 is formed between piston 34 and the surface 44 of gas receiving section 26 between the two ends 36 and 38 of piston 34. A second inlet 46 extends from bore 20 to the annular chamber 42.

An orifice insert 48 is placed at the upper end of each inlet 24 and 46 for metering the flow of gas through the inlets. A plug 50 seals the cylindrical cavity 28 by threading into the housing 18. Two threaded plugs 52 close off the bores 54 which are made in the manufacturing process to produce inlets 24 and 46.

An impact attenuating collar 56 is fitted over shoulder 30 and adapted to abut shoulder 40 of piston 34 to soften the stopping impact when the piston shoulder 40 hits thereon.

At the other end of the liquid section 32, a check valve 58 is secured onto housing 18. A fitting 59 fluidly connects the liquid section 32 with a liquid fuel supply 61 through check valve 58. The liquid fuel supply is under pressure. The valve 58 is biased to close when liquid within section 32 is under greater pressure than the pressure from the fuel supply.

Valve controlled outlet means are provided to permit the metered flow of propellant liquid from chamber 32 into the projectile bore 20. Such means includes a pair of identically constructed poppet valve assemblies 57 slightly spaced along the axial length of bore 20 and both being generally transverse to said bore 20. Each of these assemblies 57 include an outlet 60 in fluid communication with the bore 20 and the liquid receiving section 32. Each outlet 60 is spaced along bore 20 farther from firing chamber section 12 than inlets 24 and 26. Each outlet 60 has a tubular valve seat sleeve 62 secured therein. The valve seat sleeve 62 has an outwardly extending flange 64 which abuts a shoulder 66 in outlet 60. The sleeve 62 has a valve seat 63 at its lower end. A seal 65 is positioned above flange 64 and is held in place by a threaded sleeve 67 threaded into outlet 60.

A poppet valve element 68 engages seat 63 in a normally closed position. The bottom end 69 of valve 68 is recessed in outlet 60 with respect to the bore surface 71. The valve element 68 includes a valve stem 70 which passes through the liquid receiving section 32 and up through a guide member 72. The guide member 72 is secured in housing 18 by an outer flange 73 thereof resting on a fluid static seal 74 and a threaded closure 76 that abuts the flange portion 73 of member 72 which in turn engages a seal 74. Threaded closure 76 has a cavity 78 therein which houses the upper end 77 of stem 70. A spring seat 80 is secured to stem 70 and a coil spring 82 is compressed between it and guide member 72 to upwardly bias the valve 68 against seat 63. The spring seat 80 has downwardly turned flange 84 which is spaced as indicated by 86 from the top of guide member 72 in order to limit the downward opening movement of the poppet valve element 68. A purge valve 88 is fitted on top of closure cap 76.

The injector systems 23 and 25 have their respective fittings 59 connected to a pressurized liquid oxidizer supply 90.

OPERATION

In operation, the gun 10 is fired in a conventional manner wherein an explosive charge is ignited and the projectile (not shown) passes out of the firing chamber through bore 13, through bore 20 of housing 18, and bore 16 of barrel 14. The projectile is propelled by the gas pressure of the rapidly expanding hot gasses emanating from the initial explosion of the initial propellant charge. As the projectile passes by inlets 24, the gas rushes into gas receiving section 26 and exerts a high pressure force on piston head 38. Piston 34, as shown in FIG. 1, rapidly moves toward the right to a position shown in FIG. 2. Gas also enters inlet 46. The pressure in section 26 increases more rapidly than the pressure in annular chamber 42 and piston head 38 has more exposed surface facing the section 26 than facing the chamber 42, such that the piston 34 moves toward the right with minimal retarding forces from gas entering inlet 46.

In order for the gas pressure to adequately move the piston 34, the cross-sectional area of piston head 38 is larger than the sum of the areas of ends 69 in both outlets 60. In this fashion the gas pressure in gas receiving section 26 overcomes the closing pressure exerted by the gas in bore 20 exerted on the outlet valves bottom ends 69.

As piston 34 slides to the right due to the gas pressure within section 26, the liquid fuel within liquid receiving section 32 is forced out through outlets 60 as valve elements 68 are unseated from valve seats 63. The opening of valve element 68 is limited by the abutment of flange 84 against guide member 72 such that the bottom end 69 of valve element 68 remains recessed with respect to bore surface 71. As valve element 68 opens, the respective check valve 58 closes in response to the pressure of the liquid in section 32.

Outlets 60 are spaced sufficiently close to inlet 24 such that the liquid fuel enters the bore 20 after the projectile has already passed thereby but is still within the bore 16 of the barrel 14.

The injector systems 23 and 25 operate in the same fashion as injector system 22 except for the fact that they inject liquid oxidizer into the bore 20 rather than liquid fuel.

As the oxidizers and fuel mix within the bores 20 and 16, they are ignited by the present hot gas from the initial explosion and cause a further increase in gas pressure behind the projectile to thereby additionally accelerate the projectile before it leaves the barrel 14.

Figure 2:
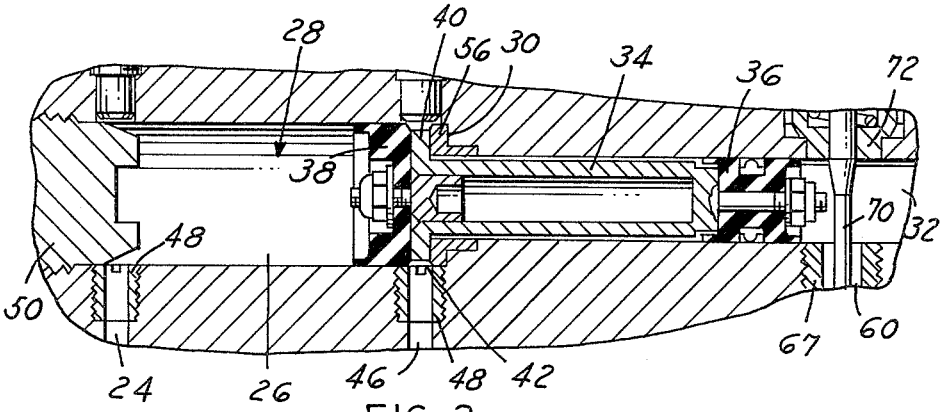
FIG. 2 is a view in section showing a portion of the mechanism shown in FIG. 1 with the piston in a second position from that shown in FIG. 1.

As the piston 34 in each injector system 22, 23 and 25 approach its position as shown in FIG. 2, the volume of annular chamber 42 decreases. As it decreases, the rapid motion of the piston causes an increase in gas pressure within chamber 42 before the gas has a chance to back out of inlet 46. The increase in gas pressure functions as a gas shock absorber to slow down the piston 34 before it abuts the solid impact attenuating collar 56.

The instant the projectile leaves barrel 14, the gas pressure within bore 20 is rapidly reduced to such an extent that it is below the fuel and oxidizer supply pressures such check valve 58 of each system 22, 23 and 25 opens and the liquid receiving section 32 is refilled with the piston 34 being forced to the left toward a position shown in FIG. 1 such that the velocity assistance mechanism is ready for the firing of the next round of ammunition.

SECOND EMBODIMENT

Figure 4:
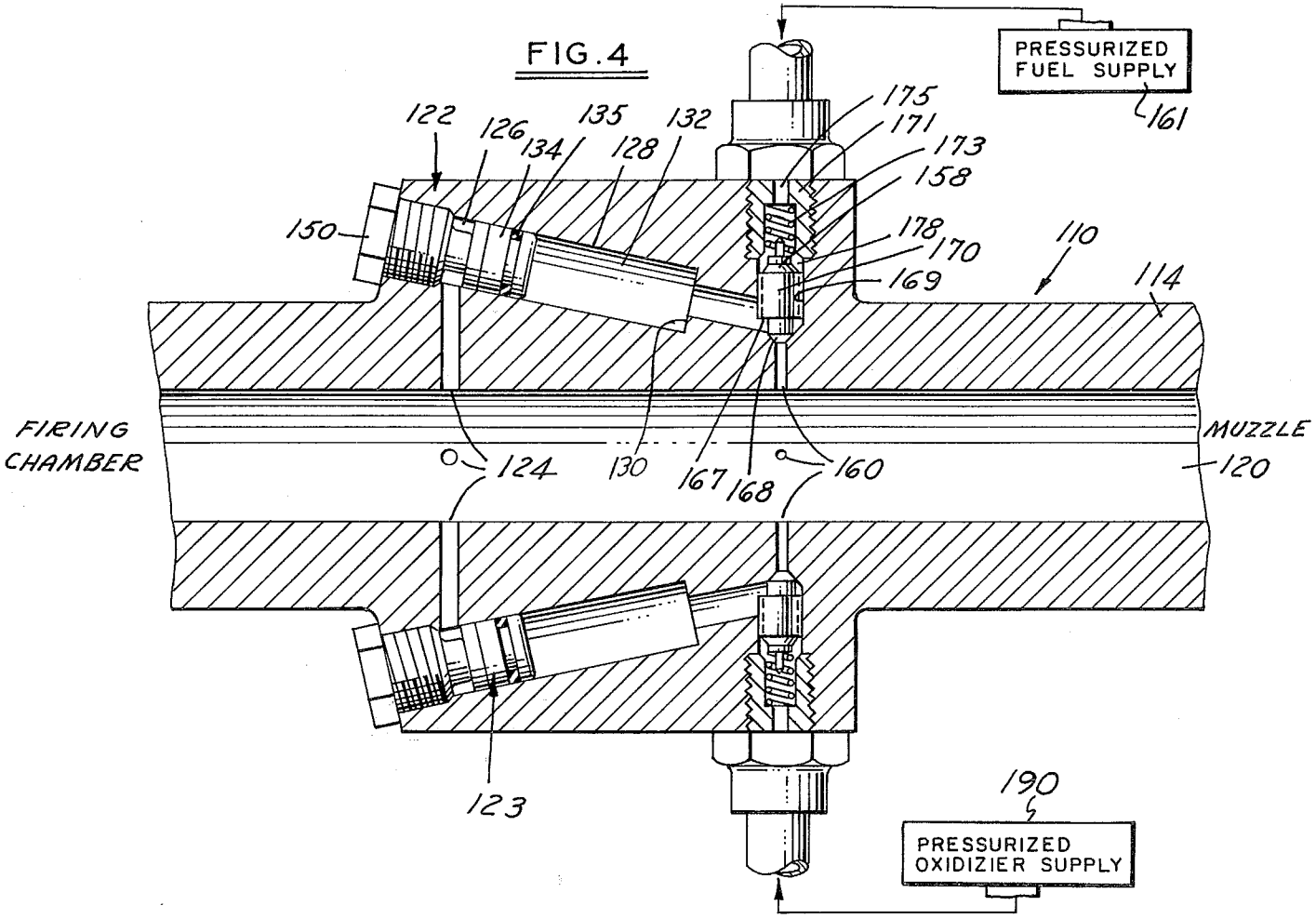
FIG. 4 is a sectional view of a portion of a gun incorporating a second embodiment of a liquid propellant velocity assistance mechanism according to the invention.

Referring now to FIG. 4, a second embodiment according to the invention is shown. A gun 110 has a barrel 114 with a bore 120 therethrough. Three injector systems 122, 123 and one not shown (being on the far side of the bore) are radially displaced about bore 120. In a manner similar to that of the first embodiment, injector system 122 meters a liquid fuel component of a propellant into the bore 120 of the barrel 114 and injector system 123 and the one not shown meter a liquid oxidizer component of the propellant into bore 120. For a detailed description of the construction each of the injector systems reference is made only to injector 122 since all three are identical in structure.

Injector system 122 includes an inlet 124 in fluid communication with the bore 120 and a gas receiving section 126 of a cylindrical cavity 128. A piston 134 in the cavity 128 having a sealing ring 135 separates the gas receiving section 126 from a liquid receiving section 132. A closure cap 150 is threaded onto the end of the cylindrical cavity 128. The cavity 128 has a radially extending shoulder 130 to act as a piston stop. An outlet 60 is in fluid communication with bore 120 and the fluid receiving section 132 of cavity 128.

A valve body 170 has a valve surface 168 at one end and a second valve surface 158 at its other end. The valve body 170 has an outwardly extending shoulder 167 downwardly facing into liquid receiving section 132. The valve body 170 fits, in part, within the valve cavity 178. A valve seat 171 is threaded into the barrel 114 which engages a coil spring 173 and is engageable by the valve surface 158. The spring 173 biases the valve body to close off the outlet 160 and open an inlet 175 leading from a liquid fuel supply under pressure 161. The inlet 175 communicates with section 132 through longitudinal grooves 169 in valve body 170.

Injector mechanism 122 operates when a projectile passes from the firing chamber down through the bore 120 and past inlets 124. The high pressure gas from the initial explosion passes through inlets 124 into the gas receiving section 122 to drive the piston 134 toward shoulder 130 and thereby reduce the volume of the liquid receiving section 132. The liquid under pressure raises the valve body 170 by applying pressure on the shoulder 167 to cause the valve surface 158 to engage seat 171 to close off inlet 175 and simultaneously to cause valve surface 158 to lift and open outlet 160. The liquid fuel then passes through outlet 160 into the bore 120.

The injector system 123 and the injector system on the far side of the bore (not shown) are connected to a liquid oxidizer supply under pressure 190 and inject oxidizer in the same fashion as injector system 122 injects fuel. The oxidizer and fuel are mixed and ignited in the bore 120 in the same fashion as in the first embodiment to provide an increase in the velocity of the projectile as it moves through the barrel 114.

As the projectile leaves bore 120, the gas pressures drop and valve body 170 drops to reclose outlet 160 and reopen supply inlet 175 such that the respective cavity sections 132 are refilled with liquid fuel or liquid oxidizer.

Modifications and variations are possible within the spirit and scope of the invention as defined by the appended claims.

The embodiments of the invention for which an exclusive privilege or property right is claimed are defined as follows:

1. A gun with a firing chamber, barrel, and projectile velocity assistance mechanism; said projectile velocity assistance mechanism comprising:

a housing secured to the gun;

said housing mounting an injector means for injecting liquid propellant into a bore passing through said barrel;

said injector means including:

said housing having a cavity therein;

a piston slidably mounted for movement between a first and second position within said cavity and dividing said cavity into a liquid propellant receiving section and gas receiving section;

an inlet in fluid communication with said bore passing through said barrel at a point spaced away from said firing chamber and with said gas receiving section of said cavity;

an outlet from said liquid propellant receiving section of said cavity in fluid communication with said bore at a point spaced from said firing chamber;

an inlet for said liquid propellant connectable to a liquid propellant supply under pressure and in fluid communication with said liquid propellant receiving section;

an outlet valve seated in said outlet and normally biased to a closed position against the pressure of said liquid propellant supply;

said outlet valve constructed to open from pressure of gas emanating from an initial explosion for propelling a projectile from said firing chamber through said bore;

said gas received into said gas receiving section and exerting pressure onto said piston which slides from said first position to said second position to force propellant out of said liquid propellant receiving section through said outlet valve where said propellant ignites to further propel said projectile before it exits said barrel.

2. A gun as defined in claim 1 wherein;

the surface area of said piston exposed to said gas receiving section normal to said direction of motion of said piston is greater than the cross-sectional area of said outlet valve such that the pressure of said gas received within said gas receiving section overcomes pressure of gas on said outlet valve from said bore to open said valve such that liquid propellant is forced from said cavity through said outlet and into said bore.

3. A gun as defined in claim 2 wherein;

said piston is stepped with a larger head section facing said gas receiving section than an opposing head surface facing said liquid receiving section of said cavity said cavity is correspondingly stepped with said gas receiving section having a larger cross-sectional area than said liquid receiving section to snugly and slidably receive said head facing said liquid receiving section and said head facing said gas receiving section with a shoulder therebetween, said shoulder spaced from said larger head section when said piston is in its first position with said larger head section positioned adjacent said shoulder when said piston is in said second position.

4. A gun as defined in claim 3 further comprising;

a second inlet in fluid communication with said bore of said barrel and with said cavity section having a larger cross-sectional area at a point between said larger head section of said piston and said shoulder of said cavity such that gas which enters therein cushions said piston as it stops in its second piston.

5. A gun as defined in claim 1 or 4 wherein; said outlet is spaced farther from said firing chamber than said first inlet and sufficiently close to said inlet such that said liquid propellant enters said bore after said projectile passes by said outlet.

6. A gun as defined in claim 1 or 4 wherein; said outlet valve comprises a valve body with a valve surface at one end for closing said outlet and a valve surface at an opposing end for closing said inlet for said liquid propellant with said valve body spring biased to normally close said outlet and normally open said inlet for said liquid propellant;

said valve body having a shoulder portion sensitive to said pressure exerted on said liquid within said cavity such that pressure exerted on said piston by said gas in said gas receiving section overcomes said spring biased valve to move said valve body to open said outlet and close said inlet for the liquid propellant.

7. A gun as defined in claim 6 wherein;

said valve body has a passage defined therein allowing liquid propellant from said propellant supply to pass therethrough into said liquid propellant receiving section of said cavity when said inlet for said liquid propellant is open.

8. A gun as defined in claim 7 wherein;

said valve body is generally positioned transverse to the longitudinal axis of said cavity, transverse to said barrel, and radially aligned with the longitudinal axis of said barrel.

9. A gun as defined in claims 1 or 4 wherein;

said outlet valve comprises a valve body with a valve surface at one end for seating in sealing relationship onto a valve seat of said outlet;

a spring seat fixed to said housing;

a second spring seat fixed to said valve body;

a spring compressed therebetween for biasing said valve to close said outlet;

a shoulder flange fixed to said valve body sensitive to said pressure of said liquid propellant within said cavity such that pressure exerted by said gas overcomes said spring to open said valve.

10. A gun as defined in claim 9 wherein;

said valve seat is recessed with respect to the side surface of said bore;

said valve surface is positioned toward the bore side of said valve seat with said valve biased away from the central axis of said barrel;

said valve is openably by movement toward the axis of said barrel and away from said valve seat;

complementary abutments secured to said housing and valve are normally spaced apart when said valve is closed and abut each other when said valve is opened to limit the opening movement of said valve such that said body does not intrude into said bore.

11. A gun as defined in claim 10 further comprising;

a check valve in the inlet from said liquid propellant supply normally open from pressure exerted by said liquid propellant supply and closeable by said gas pressure exerted upon said piston and transmitted through said liquid propellant in said cavity;

pressure of said liquid propellant supply being sufficient to move said piston back to its first position and refill liquid propellant receiving section of said cavity after high pressure gas dissipates out of said gas receiving section.

12. A gun as defined in claim 9 wherein said velocity assistance mechanism further comprises:

a second injector means mounted on the same housing secured to said gun;

said second injector means fluidly connected to a liquid oxidizer component of said propellant supply;

said first mentioned injector means fluidly connected to a liquid fuel component of said propellant supply;

outlets of said first and second injector means being sufficiently close to each other such that said fuel and oxidizer exiting therefrom into said bore mix and ignite therein to further propel said projectile out of said barrel.

13. A gun as defined in claim 12 wherein;

the outlets of said first and second injector means are radially displaced about said barrel and axially aligned.

14. A gun as defined in claim 1 wherein;

said velocity assistance mechanism further comprises:

a second injector means;

said second injector means fluidly connected to a liquid oxidizer component of said propellant supply;

said first mentioned injector means fluidly connected to a liquid fuel component of said propellant supply;

outlets of said first and second injector means being sufficiently close to each other such that said fuel and oxidizer exiting therefrom into said bore mix and ignite therein to further propel said projectile out of said barrel.

15. A gun as defined in claim 14 wherein;

the outlets of said first and second injector means are radially displaced about said barrel and axially aligned.

16. A gun as defined in claim 1 wherein;

said housing has a bore therethrough;

said housing at one end of said bore is rigidly secured to said barrel with the bore of said barrel aligned with the bore of said housing;

said housing at an opposing end of said bore therethrough is rigidly secured to the gun housing said firing chamber with the longitudinal axis of said firing chamber aligned with the bore of said housing.

17. A gun with a firing chamber, barrel, and a velocity assistance mechanism; said velocity assistance mechanism comprising;

a housing secured to said gun;

said housing mounting an injector means for injecting liquid propellant into a bore through said barrel;

said injector means including:

said housing having a cavity therein;

means for decreasing the volume of said cavity;

said decreasing means being responsive to a gas pressure from an initial explosion for projecting a projectile through the barrel;

said cavity fluidly connectable to a liquid propellant supply;

an outlet in fluid communication with said cavity and said bore through said barrel;

a valve in said outlet normally biased to a closed position and openable upon increase in pressure exerted upon said liquid propellant in said cavity caused by said decreasing means for decreasing the volume of said cavity to allow liquid propellant therein through the outlet and into said bore where it ignites to increase the speed of said projectile before exiting said barrel.

18. A gun as defined in claim 17 wherein;

said velocity assistance mechanism further comprises:

a second injector means secured to said gun;

said second injector means fluidly connected to a liquid oxidizer component supply of said propellant supply;

said first mentioned injector means fluidly connected to a liquid fuel component supply of said propellant supply;

outlets of said first and second injector means being sufficiently close to each other such that said fuel and oxidizer exiting therefrom into said bore mix and ignite therein to further propel said projectile out of said barrel.

19. A gun with a firing chamber, barrel, and a velocity assistance mechanism; said velocity assistance mechanism comprising;

a housing attached to said gun, said housing having two cavities therein, each cavity with gas receiving section and a liquid receiving section; each liquid receiving section respectively in fluid communication with a liquid oxidizer and fuel component of a propellant;

an inlet in fluid communication with a bore through said barrel and each gas receiving section, an outlet in fluid communication with said bore and each liquid receiving section;

a valve in each outlet normally biased to a closed position and openable upon an increase in pressure of said liquid in each cavity exerted by high pressure gas to allow said liquid therein through said outlets and into said bore such that said fuel and oxidizer mix in said bore to ignite and further propel a projectile through said barrel;

the interface between said gas and liquid receiving sections defining a greater surface area in cross-section than the cross-section of said outlets from said liquid receiving section to said bore.

20. A gun as defined in claim 19 wherein;

said interface between said gas and liquid receiving section comprises a moveable element which separates the gas receiving section from the liquid section in said cavity and is moveable to provide variation in volume of said respective sections such that upon increase in volume of said gas receiving section, the volume of said liquid receiving section decreases and vice versa.

21. A projectile velocity assistance mechanism for a gun comprising;

a housing having a bore therethrough;

said housing at one end of said bore being rigidly securable to a barrel of a gun with a bore of said barrel alignable with said bore of said housing;

said housing at an opposing end of said bore is rigidly securable to a section of said gun housing a firing chamber with the longitudinal axis of said firing chamber alignable with said bore of said housing;

said housing mounting an injector means for injecting liquid propellant into said bore of said housing;

said injector means including:

said housing having a cavity therein;

a piston slidably mounted for movement between a first and second position within said cavity and dividing said cavity into a liquid propellant receiving section and a gas receiving section;

an inlet in fluid communication with said bore of said housing between said ends thereof and with said gas receiving section;

an outlet in fluid communication with said liquid propellant receiving section and with said bore of said housing between said ends thereof;

an inlet for said liquid propellant connectable to a liquid propellant supply under pressure and in fluid communication with said liquid propellant receiving section;

an outlet valve seated in said outlet and normally biased to a closed position against the pressure of said liquid propellant supply;

said outlet valve openable from pressure of gas emanating from an initial explosion for propelling a projectile from said firing chamber through said bore;

said piston operable by said gas received into said gas receiving section and exerting pressure onto said piston which slides from said first position to said second position to force propellant out of said liquid propellant receiving section through said outlet valve where said propellant ignites to further propel said projectile before it exits said barrel.

22. A projectile velocity assistance mechanism as defined in claim 21 wherein;

said velocity assistance mechanism further comprises;

a second injector means mounted on the same housing secured to said gun;

said second injector means having fluidly connected to a liquid oxidizer component of said propellant supply;

said first mentioned injector means fluidly connected to a liquid fuel component of said propellant;

outlets of said first and second injector means being sufficiently close to each other such that said fuel and oxidizer exiting therefrom into said bore mix and ignite therein to further propel said projectile out of said barrel.

23. A projectile velocity assistance mechanism for a gun having an initial explosive means constructed to provide an initial hot gas pressure charge;

said mechanism including a bore having a firing chamber end and a muzzle end and through which a projectile is propelled by said hot gas pressure charge;

said mechanism also including a liquid propellant supply and metering means constructed to meter liquid propellant from said supply into said bore at a location intermediate said ends of said bore;

gas pressure responsive means coupled with said metering means and constructed to cause said metering means to meter propellant into said bore at a point in time after said initial explosive means has provided said hot gas pressure charge and a projectile propelled by said charge is between said location and said muzzle end of said bore whereby said propellant is ignited in said bore and increases the gas pressure behind said projectile and thus the velocity of said projectile.

24. A velocity assistance mechanism as defined in claim 23 and including:

said gas pressure responsive means having means connected with said bore at a second location between said first mentioned location and said firing chamber end and operative to cause said metering means to meter said propellant in response to a hot gas pressure charge at said second location.

* * * * *

UNITED STATES PATENT AND TRADEMARK OFFICE

CERTIFICATE OF CORRECTION

PATENT NO. : 4,336,741

DATED : June 29, 1982

INVENTOR(S) : William R. Bains

It is certified that error appears in the above-identified patent and that said Letters Patent are hereby corrected as shown below:

Title Page, Inventor, the inventor's last name "Baines" should read -- Bains --.

Title Page, Assignee, please delete "Ford Motor Company, Dearborn," and insert -- Ford Aerospace & Communications Corporation, Detroit, --.

Column 1, line 66, after "pressure" insert -- which forces open the valve --; and line 67, delete "which forces open the valve".

Column 2, line 21, after "Preferably," insert -- a --.

Column 5, line 31, after "construction" insert -- of --.

Column 7, claim 3, line 4, delete "surface" and insert -- section --;

claim 3, line 5, after "cavity" insert -- ; and -- ; and claim 3, line 10, after "head" insert -- section --.

UNITED STATES PATENT AND TRADEMARK OFFICE

CERTIFICATE OF CORRECTION

PATENT NO. : 4,336,741

DATED : June 29, 1982

INVENTOR(S) : William R. Bains

It is certified that error appears in the above-identified patent and that said Letters Patent are hereby corrected as shown below:

Column 9, claim 19, line 46, after "with" insert -- a --.

Signed and Sealed this

*Twenty-sixth* Day of *October 1982*

[SEAL]

*Attest:*

GERALD J. MOSSINGHOFF

*Attesting Officer*

*Commissioner of Patents and Trademarks*